US011293643B2

(12) United States Patent
Lee

(10) Patent No.: US 11,293,643 B2
(45) Date of Patent: Apr. 5, 2022

(54) COOKING APPLIANCE AND METHOD FOR CONTROLLING A COOKING APPLIANCE

(71) Applicant: LG ELECTRONICS INC., Seoul (KR)

(72) Inventor: Geonsik Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 809 days.

(21) Appl. No.: 14/879,404

(22) Filed: Oct. 9, 2015

(65) Prior Publication Data

US 2016/0178215 A1 Jun. 23, 2016

(30) Foreign Application Priority Data

Dec. 17, 2014 (KR) ..... 10-2014-0182191

(51) Int. Cl.
*F24C 3/12* (2006.01)
*F24C 7/08* (2006.01)

(52) U.S. Cl.
CPC ..... *F24C 7/086* (2013.01)

(58) Field of Classification Search
CPC ..... F24C 7/086; H05B 6/1218
See application file for complete search history.

(56) References Cited

U.S. PATENT DOCUMENTS 4,149,217 A * 4/1979 Tucker ..... H05B 6/062 219/492
4,169,222 A * 9/1979 Tucker ..... H05B 6/062 219/506
4,345,145 A * 8/1982 Norwood ..... A47J 37/0623 219/408
4,453,068 A * 6/1984 Tucker ..... H05B 6/065 219/622

(Continued)

FOREIGN PATENT DOCUMENTS

CN 1971485 5/2007
CN 102315630 1/2012

(Continued)

OTHER PUBLICATIONS

Chinese Office Action dated Jul. 19, 2017 (English Translation).

*Primary Examiner* — Steven N Leff
(74) *Attorney, Agent, or Firm* — Ked & Associates LLP

(57) ABSTRACT

A cooking appliance and a method for controlling a cooking appliance are provided. The cooking appliance may include at least one cooking device that cooks items to be cooked using a heat source, a touch panel type input that receives a command for controlling operation of the at least one cooking device, and a controller that receives a touch input signal from the input and controls the operation of the at least one cooking device. The input may include a first touch circuit board and a second touch circuit board, which may communicate with each other and may be electrically connected with the controller. If an abnormal signal is trans- (Continued)

mitted to the second touch circuit board from the first touch circuit board, the controller may stop the operation of the cooking device or operation of the cooking appliance. When the input is damaged or malfunctions, the operation of at least one cooking device or the operation of the cooking appliance may be stopped, thereby preventing secondary damage, such as fire.

14 Claims, 5 Drawing Sheets

(56) References Cited

U.S. PATENT DOCUMENTS 4,511,781 A * 4/1985 Tucker ..... H05B 6/062 219/506
4,633,067 A * 12/1986 Payne ..... F24C 7/083 219/483
4,894,493 A * 1/1990 Smith ..... H01H 13/702 200/5 A
5,366,185 A * 11/1994 Michael ..... A47L 15/42 248/27.1
5,723,846 A * 3/1998 Koether ..... F24C 7/087 219/483
5,862,738 A * 1/1999 Warne ..... A47J 31/007 99/281
6,112,135 A * 8/2000 Peterson ..... G05B 9/02 700/209
6,674,387 B1 * 1/2004 Ott ..... H03M 1/506 341/155
6,730,889 B1 * 5/2004 Jones-Lawlor ..... A47J 27/004 219/435
6,919,546 B2 * 7/2005 Lee ..... H05B 6/6402 219/506
6,946,630 B2 * 9/2005 Lee ..... B60R 1/10 219/506
7,076,324 B2 * 7/2006 Harkcom ..... G05B 19/104 126/20
8,338,757 B2 * 12/2012 Isoda ..... H05B 6/062 219/450.1
8,748,783 B2 * 6/2014 Hensel ..... A47J 37/0635 219/412
8,753,700 B2 * 6/2014 Wisner ..... A47J 39/006 426/231
2004/0000237 A1 * 1/2004 Wu ..... A47J 31/002 99/283
2010/0323071 A1 * 12/2010 Nevarez ..... B67D 1/0021 426/231
2011/0123688 A1 * 5/2011 Deo ..... B67D 1/0027 426/231
2012/0288595 A1 * 11/2012 Randall ..... H05B 1/0266 426/231
2013/0240505 A1 * 9/2013 Moon ..... H05B 6/062 219/632
2015/0028022 A1 * 1/2015 Moon ..... H05B 6/1263 219/622
2015/0308694 A1 * 10/2015 Christiansen ..... H05B 6/12 219/626

FOREIGN PATENT DOCUMENTS

CN 103717114 4/2014
JP 11-259216 9/1999
JP 2011-076859 A 4/2011
JP 2014-043996 A 3/2014
KR 10-2000-0013141 A 3/2000

* cited by examiner

COOKING APPLIANCE AND METHOD FOR CONTROLLING A COOKING APPLIANCE

CROSS-REFERENCE TO RELATED APPLICATION(S)

This application claims priority to Korean Patent Application No. 10-2014-0182191, filed in Korea on Dec. 17, 2014, which is hereby incorporated by reference as if fully set forth herein.

BACKGROUND

1. Field

A cooking appliance and a method for controlling a cooking appliance are disclosed herein.

2. Background

In general, cooking appliances are household or indoor appliances that cook food or other items using electricity or other forms of energy, such as gas, for example. Such cooking appliances may be classified according to a kind of heat source. Cooking appliances using gas as a heat source may include a gas range, a gas oven, and a gas oven range, for example. Cooking appliances using electricity as a heat source may include an induction heating range and a microwave oven, for example. There are also cooking appliances in which an induction heating range using electricity and a gas oven using gas are combined.

In consideration of operational convenience and an elegant appearance, recently developed cooking appliances are generally equipped with a touch panel type command input unit or input (or a manipulation unit or device) to operate the cooking appliance, through which a user may input an operation command by touch. The touch panel type input unit or input may include a touch circuit board configured to recognize a touch signal and transmit the signal to a control unit or controller, and a cancellation command recognition unit or device, through which a user may input a cancellation command to cancel a cooking operation. Because such a cooking appliance inevitably generates high-temperature heat, disorder or malfunction of the cancellation command recognition unit or device may cause secondary damage, such as a burn or fire, to a user.

In other words, a conventional cooking appliance equipped with a touch panel type input has a problem in that a user cannot input a cancellation command into the input when the cancellation command recognition device provided at the input malfunctions, connection between the cancellation command recognition device and the touch circuit board is interrupted, or the touch circuit board malfunctions. In particular, disconnection between the cancellation command recognition device and the touch circuit board is a most common problem. Such disorder or malfunction of the input (especially, the cancellation command recognition device and the touch circuit board) may cause a user to experience anxiety.

An attempt may be made to solve the above problems whereby the cancellation command recognition device is divided into two parts, for example, two touch input recognition devices, and the respective divided cancellation command recognition devices may be electrically connected with the touch circuit board. However, dividing the cancellation command recognition device into two parts is vulnerable to noise due to frequency interference, which may cause malfunction of the cooking appliance or unintended input of a cancellation command even when there is no touch input.

BRIEF DESCRIPTION OF THE DRAWINGS

Embodiments will be described in detail with reference to the following drawings in which like reference numerals refer to like elements, and wherein.

DETAILED DESCRIPTION

Figure 1A:
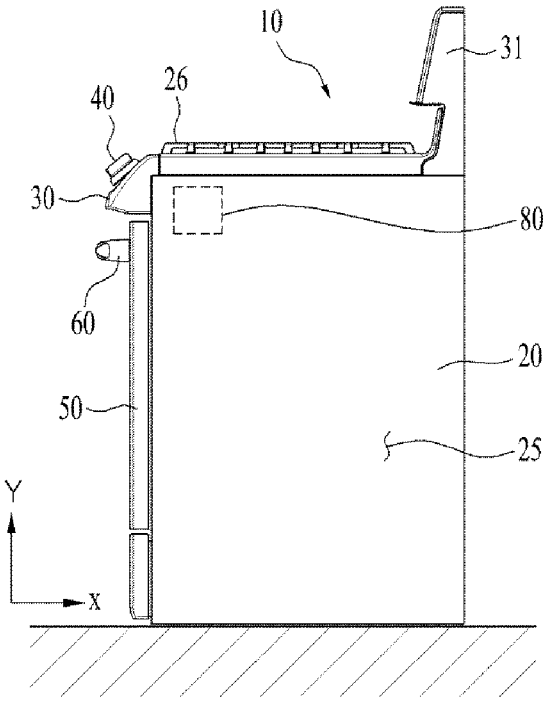
FIGS. 1A and 1B are views of a cooking appliance according to an embodiment.

Reference will now be made in detail to embodiments, examples of which are illustrated in the accompanying drawings. The embodiments described in the specification and shown in the drawings are illustrative only and are not intended to represent all aspects. Wherever possible, the same or like reference numbers have been used throughout the drawings to refer to the same or like parts. In the drawings, a component's size, and shape, for example, may be exaggerated for clarity and convenience.

Hereinafter, embodiments will be described with reference to the attached drawings.

Figure 1B:
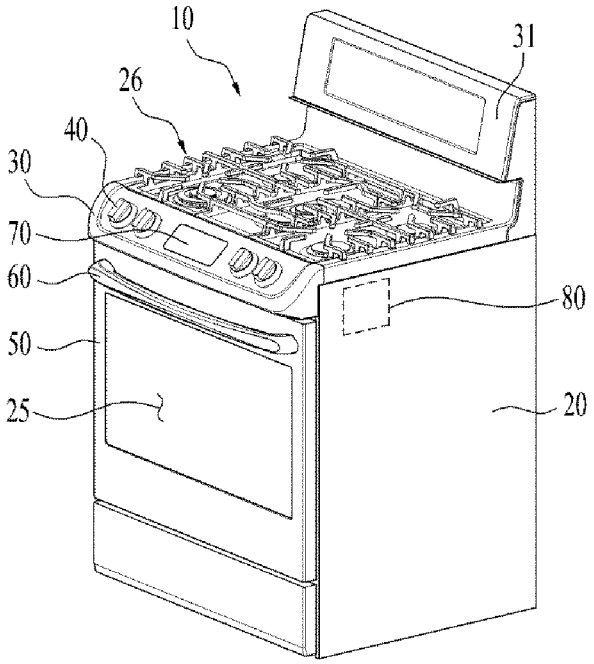

FIGS. 1A and 1B are schematic side and perspective views of a cooking appliance according to an embodiment. In particular, FIG. 1A is a schematic side view of a cooking appliance according to an embodiment, and FIG. 1*b* is a schematic front view of the cooking appliance of FIG. 1. Although characteristics will be explained with reference to the cooking appliance, for example, a gas oven range, depicted in FIGS. 1A and 1B, it will be apparent that characteristics of embodiments may be applied to a microwave oven or an induction heating range that cook items to be cooked using electricity as a heat source, for example.

In FIG. 1A, an X-axis direction may be defined as a front-back direction, that is, a forward and backward direction, and a Y-axis direction may be defined as a vertical direction, that is, an upward and downward direction. Referring to FIGS. 1A and 1B, a cooking appliance 10 according to an embodiment, which may be a gas oven range, may include a cabinet 20 that defines an outer appearance of the cooking appliance 10, and cooking units or devices 25 and 26, which may be provided at the cabinet 20 to cook items to be cooked, such as food, using a heat source.

The cooking devices 25 and 26 may include a cooking chamber 25, which may be formed inside of the cabinet 20 to accommodate items to be cooked therein, and a cooktop 26, which may be provided at a top of the cabinet 20 to place containers used for cooking thereon. In a case in which the cooking appliance includes only a gas range function or an induction heating range function, the cooking chamber 25 may be omitted.

Items to be cooked may be put into the cooking chamber 25, and the items accommodated in the cooking chamber 25 may be cooked using gas or electricity as a heat source. In other words, the cooking chamber 25 may function as a gas oven or a microwave oven according to the heat source.

Containers for cooking may be placed on the cooktop 26. That is, while a container, such as a pot, is positioned on the cooktop 26, items may be cooked by heat generated from the cooktop 26.

For example, in a case in which gas is used as a heat source for the cooktop 26, the cooktop 26 may function as a gas range. On the other hand, in a case in which electricity is used as a heat source for the cooktop 26, the cooktop 26 may function as an induction heating range.

The cooking chamber 25 and the cooktop 26 may be referred to as a cooking unit or device, which cooks items to be cooked, such as food, using heat from gas or electricity. In this embodiment, the cooktop 26 may be an example of a cooking device that directly uses a gas flame, for example, a gas range, and the cooking chamber 25 may be an example of a cooking device that uses heat radiation or convection from a gas flame, for example, a gas oven.

A door 50 may be provided a front portion of the cabinet 20 in order to open and close the cooking chamber 25, and a door handle 60 may be provided at or on door 50. A user may open or close the door 50 using the door handle 60. The cooking appliance 10 according to an embodiment may further include a front panel 30 and a rear panel 31, which may be integrally formed with the cabinet 20 or removably coupled to the cabinet 20.

Various manipulation units or devices, through which a user may be manipulate the cooking appliance 10, may be provided at the front panel 30 and/or the rear panel 31. Although the manipulation devices will be explained based on structure in which the manipulation devices are provided at the front panel 30, manipulation devices having a same function may be provided at or on the rear panel 31 rather than the front panel 30. Further, manipulation devices having different functions may be provided at both the front panel 30 and the rear panel 31.

For example, the cooking appliance 10 according to an embodiment may include a manipulation unit or device, such as a knob 40, to turn on/off the cooktop 26 or adjust a flame intensity of the cooktop 26. The knob 40 may be provided at or on the front panel 30. By rotating the knob 40, the user may control operation of the cooking device, in particular, the cooktop 26.

The cooking appliance 10 according to an embodiment may further include an input unit or input 70 to turn on/off the cooking chamber 25 or adjust a flame intensity in the cooking chamber 25. It is shown in the drawings that the input 70 is provided at or on the front panel 30; however, embodiments are not limited thereto. For example, the input 70 may be provided at the rear panel 31. That is, the input 70 may be provided on a front surface of the rear panel 31.

In a case in which the heat source of the cooktop 26 is electricity, that is, the cooktop 26 is an induction heating range, the input 70 may control operation of the cooktop 26. In other words, a user may control operation of the cooking devices, such as the cooking chamber 25 and the cooktop 26, through the input 70.

For example, the input 70 may be provided at or on the cabinet 20, and may be a touch panel, through which a user may input a command for controlling the operation of the cooking device, in particular, the cooking chamber 25. Accordingly, through a touch on the input 70, the user may input commands including selection of a course to be performed in the cooking chamber 25, start of the selected course, and cancellation of the operation of the cooking appliance 10, for example.

Because various types of touch panels capable of recognizing touch input are already well known, a detailed explanation of the touch panel type input 70 according to embodiments has been omitted.

The cooking appliance 10 according to an embodiment may further include a controller 80 to receive a touch input signal from the input 70 and control the operation of the cooking device, for example, the cooking chamber 25.

Hereinafter, the phrase "controlling the operation of the cooking chamber 25" may refer to controlling the operation of the heat source provided at the cooking chamber 25.

The controller 80 may start or stop the operation of the cooking device based on a signal or command input through the input 70.

Hereinafter, a command transmission process of the input 70 and the controller 80 will be explained with reference to FIG. 2.

Figure 2:
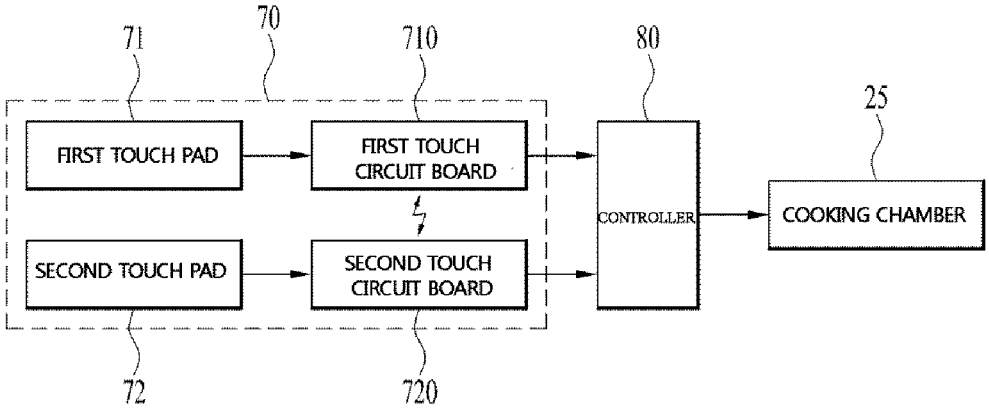
FIG. 2 is a block diagram illustrating a signal transmission relationship between an input and a controller provided in the cooking appliance of FIG. 1.

FIG. 2 is a block diagram illustrating a signal transmission relationship between an input and a controller of the cooking appliance of FIG. 1. Referring to FIG. 2, the input 70 according to an embodiment may include one or more touch pads 71 and 72 and one or more touch circuit boards 710 and 720. The touch circuit boards 710 and 720 may be touch integrated circuits (ICs), for example.

A touch signal recognized through the touch pads 71 and 72 may be transmitted to the touch circuit boards 710 and 720, which may be electrically connected with the touch pads 71 and 72, and the touch circuit boards 710 and 720 may transmit the signal to the controller 80. Then, the controller 80 may control operation of the cooking device, for example, the cooking chamber 25, of the cooking appliance 10 based on the signal.

In particular, the input 70 may include a first touch pad 71 having one or more predetermined recognition units or devices displayed thereon, a first touch circuit board 710 electrically connected with the first touch pad 71, a second touch pad 72 having one or more predetermined recognition units or devices displayed thereon, which may be different from those of the first touch pad 71, and a second touch circuit board 720 electrically connected with the second touch pad 72. The first touch circuit board 710 and the second touch circuit board 720 may be, respectively, electrically connected with the controller 80. The first touch circuit board 710 and the second touch circuit board 720 may be, respectively, connected with the controller 80 by separate electrical connection means, such as electric wires or circuits, for example.

One or more predetermined recognition devices may be displayed on the first touch pad 71, and a user may start a selected course by touching a desired one of the recognition devices displayed on the first touch pad 71. If one of the recognition devices displayed on the first touch pad 71 is touched, the touch signal may be transmitted to the first touch circuit board 710. At this time, the first touch circuit board 710 may transmit the touch signal to the controller 80, and the controller 80 may control the operation of the cooking device, for example, the cooking chamber 25, according to the course selected by the user's touch on the recognition unit.

One or more predetermined courses, which may be different from those of the first touch pad 71, may be displayed on the second touch pad 72. The user may start the selected course by touching a desired one of the courses displayed on the second touch pad 72. If one of the courses displayed on the second touch pad 72 is touched, the touch signal may be transmitted to the second touch circuit board 720. The second touch circuit board 720 may transmit the touch signal to the controller 80, and the controller 80 may control the operation of the cooking device, for example, the cooking chamber 25, according to the course selected by the user.

The first touch circuit board 710 and the second touch circuit board 720 may communicate with each other. In other words, the first touch circuit board 710 and the second touch circuit board 720 may communicate with each other through electrical connection or over a wireless link, for example. The term "communicate" or "communication" may refer to signal exchange between the first touch circuit board 710 and the second touch circuit board 720.

For example, if power is supplied to the cooking appliance 10, the first touch circuit board 710 may continuously transmit a specific signal to the second touch circuit board 720. In other words, if power is supplied to the cooking appliance 10, the second touch circuit board 720 may continuously receive the specific signal from the first touch circuit board 710. The term "specific signal" may refer to a pulse signal represented by a high-frequency "1" and a low-frequency "0".

When the first touch circuit board 710 and the second touch circuit board 720 normally communicate with each other, the second touch circuit board 720 may receive a normal signal, in which the high frequency and the low frequency are alternately repeated, that is, "1010101 010 . . . ", from the first touch circuit board 710. However, if the first touch pad 71 is damaged or malfunctions or if there is a problem with the electrical connection between the first touch pad 71 and the first touch circuit board 710, the second touch circuit board 720 may receive only the high-frequency signal, that is, "11111 . . . ", or only the low-frequency signal, that is, "00000 . . . ", from the first touch circuit board 710. At this time or in this case, the second touch circuit board 720 or the controller 80 may judge such a signal as an abnormal signal.

Also, when the first touch circuit board 710 is damaged or malfunctions, no signal may be transmitted to the second touch circuit board 720 from the first touch circuit board 710. At this time or in this case, the second touch circuit board 720 or the controller 80 may judge such a state, in which the second touch circuit board 720 receives no signal, as an abnormal signal.

As described above, if the signal transmitted to the second touch circuit board 720 from the first touch circuit board 710 is judged as an abnormal signal, the controller 80 may control the cooking device, for example, the cooking chamber 25, so that the operation of the cooking device automatically stops. This is to prevent secondary damage, such as fire, which may be caused when manipulation, in particular, manipulation for stopping operation through the input 70 becomes impossible.

If an abnormal signal has been transmitted to the second touch circuit board 720 from the first touch circuit board 710 for a predetermined period of time, the controller 80 may stop the operation of the cooking device. This is because, even when there is no special problem with the first touch pad 71 or the first touch circuit board 710, an abnormal signal may be transmitted to the second touch circuit board 720 from the first touch circuit board 710 due to contact with a foreign material, a user's unintended manipulation, or an error of a program pre-stored in the controller 80. The predetermined period of time may be in a range from approximately 1 minute to approximately 10 minutes, for example, a range from approximately 3 minutes to approximately 7 minutes, or the predetermined time may be approximately 5 minutes.

Hereinafter, a connection relationship of the signal recognition devices displayed on the input, the touch circuit boards, and the controller will be explained.

Figure 3:
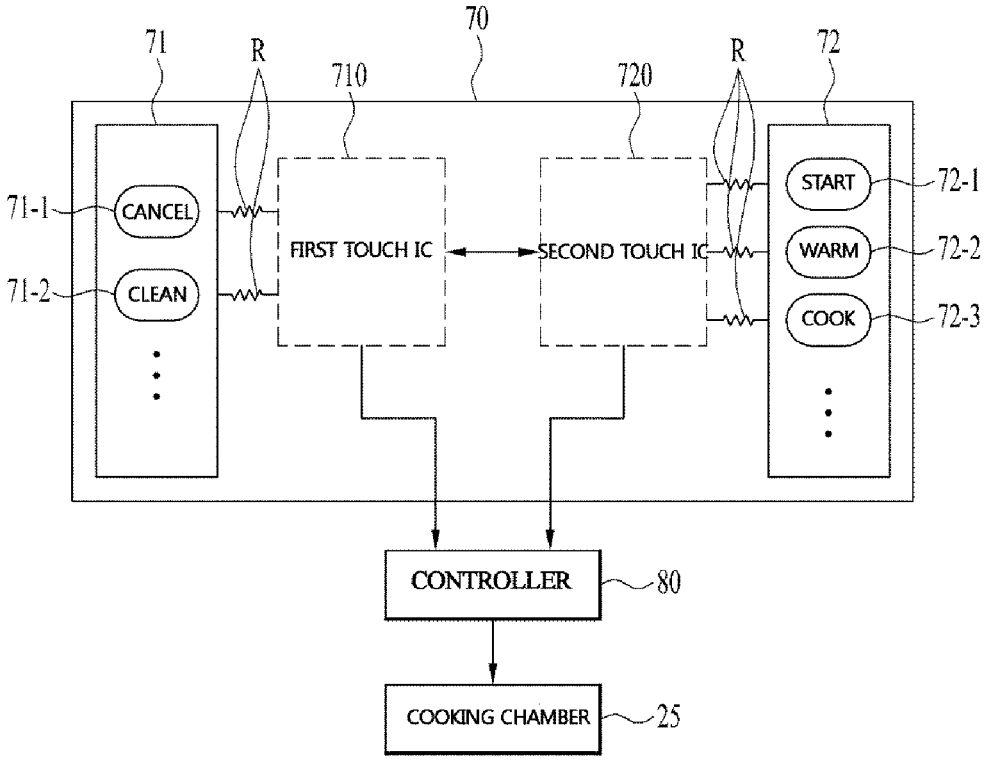
FIG. 3 is a block diagram illustrating a connection relationship of a plurality of signal recognition devices displayed on the input, touch circuit boards, and the controller of the cooking appliance of FIG. 1.

FIG. 3 is a block diagram illustrating a connection relationship of a plurality of signal recognition devices displayed on the input, touch circuit boards, and the controller of the cooking appliance of FIG. 1. Referring to FIG. 3, in the cooking appliance 10 according to an embodiment, the input 70 may be electrically connected with the controller 80, and the controller 80 may control the cooking device, for example, the cooking chamber 25, based on the signal input through the input 70, which was described above with reference to FIG. 2.

The input 70 may include first touch pad 71 and second touch pad 72, which may recognize a touch input. According to an embodiment, the first touch pad 71 and the second touch pad 72 may be arranged spaced apart from each other at both side portions in a widthwise direction of the input 70. Of course, if both the first touch pad 71 and the second touch pad 72 are provided at or in the input 70, arrangement positions of the first touch pad 71 and the second touch pad 72 on the input 70 do not matter.

The first touch pad 71 may be provided with one or more recognition units or devices 71-1 and 71-2, and the second touch pad 72 may also be provided with one or more recognition units or devices 72-1, 72-2 and 72-3. The recognition devices 71-1 and 71-2 provided at or on the first touch pad 71 may include a CANCEL command recognition unit or device 71-1 and a CLEAN command recognition unit or device 71-2, for example. The recognition units or device 72-1, 72-2 and 72-3 provided at or on the second touch pad 72 may include a START command recognition unit or device 72-1, a WARM command recognition unit or device 72-2, a COOK command recognition unit or device 72-3, and a BROIL command recognition unit or device (not shown), for example.

The first touch pad 71 may be electrically connected with first touch circuit board 710, that is, a first touch IC, provided at the input 70, and the second touch pad 72 may be electrically connected with second touch circuit board 720, that is, a second touch IC, provided at the input 70. The recognition devices 71-1 and 71-2 provided at or on the first touch pad 71 may be, respectively, connected with the first touch circuit board 710 through separate electrical connection means, such as, electric wires, for example.

A same number of connection means and resistors R as the recognition devices 71-1 and 71-2 provided at the first touch pad 71 may be provided between the recognition devices 71-1 and 71-2 of the first touch pad 71 and the first touch circuit board 710. The recognition devices 72-1, 72-2 and 72-3 provided at the second touch pad 72 may be, respectively, connected with the second touch circuit board 720 through separate electrical connection means, such as, electric wires, for example.

Therefore, the signal input through the recognition devices 71-1 and 71-2 provided at the first touch pad 71 may be transmitted to the first touch circuit board 710, and the signal input through the recognition devices 72-1, 72-2 and 72-3 provided at the second touch pad 72 may be transmitted to the second touch circuit board 720. That is, the first touch circuit board 710 may recognize a touch signal input through the CANCEL command recognition device 71-1 and the CLEAN command recognition device 71-2 and transmit the signal to the controller 80, and the second touch circuit board 720 may recognize a touch signal input through the START command recognition device 72-1, the WARM command recognition device 72-2, and the COOK command recognition device 72-3 and transmit the signal to the controller 80.

If a single touch pad is used, the signal input through the touch pad may be vulnerable to noise, which may cause malfunction of the touch pad. This is why two touch pads 71 and 72 and two touch circuit boards 710 and 720 corresponding to the touch pads 71 and 72 are used.

When the first touch pad 71 is damaged (or malfunctions), the first touch circuit board 710 is damaged (or malfunctions), or there is a problem with the electrical connection between the first touch pad 71 and the first touch circuit board 710, the second touch circuit board 720 may transmit an abnormal signal from the first touch circuit board 710 to the controller 80, in order to prevent problems, for example, damage, such as fire, which may be caused when the input 70 is out of order. If the controller 80 has received the abnormal signal for a predetermined period of time, the controller 80 may stop the operation of the cooking device, for example, the cooking chamber 25.

In this embodiment, the controller 80 may determine the predetermined period of time for which the controller 80 receives the abnormal signal. In particular, the controller 80 may determine whether the abnormal signal has been transmitted to the second touch circuit board 720 from the first touch circuit board 710 for the predetermined period of time. Accordingly, the controller 80 may continuously receive information about the abnormal signal, which may be transmitted from the first touch circuit board 710 to the second touch circuit board 720, from the second touch circuit board 720.

In another embodiment, the second touch circuit board 720 may determine the predetermined period of time for which the second touch circuit board 720 receives the abnormal signal. In particular, when the second touch circuit board 720 has received the abnormal signal from the first touch circuit board 710 for the predetermined period of time, the second touch circuit board 720 may transmit a signal for stopping the operation of the cooking device to the controller 80. When the controller 80 receives the signal for stopping the operation of the cooking device, the controller 80 may immediately control the cooking device or the cooking appliance 10 so that the operation of the cooking device stops or the cooking appliance 10 is turned off.

As described above, the reason that the second touch circuit board 720 is configured to sense an abnormal signal transmitted from the first touch circuit board 710 through the communication with the first touch circuit board 710 is because the CANCEL command recognition device 71-1 is included in the first touch pad 71 connected to the first touch circuit board 710. This may prevent damage, such as fire, due to non-operation or malfunction of the CANCEL command recognition device 71-1, which may be a most serious problem in the cooking appliance 10 using high-temperature heat.

The abnormal signal, which may be transmitted through the communication between the first touch circuit board 710 and the second touch circuit board 720, may occur in at least one of a plurality of cases including damage or malfunction of the CANCEL command recognition device 71-1, disconnection, for example, damage to the resistors R, between the CANCEL command recognition device 71-1 and the first touch circuit board 710, and damage or malfunction of the first touch circuit board 710. In other words, the second touch circuit board 720 may sense the abnormal signal in at least one of a case of damage or malfunction of the CANCEL command recognition device 71-1, disconnection, for example, damage to the resistors R, between the CANCEL command recognition device 71-1 and the first touch circuit board 710, and damage or malfunction of the first touch circuit board 710.

In the case in which the CANCEL command recognition device is provided at the second touch pad 72 rather than the first touch pad 71, in contrast to the above-described structure, the input may be configured such that the abnormal signal is transmitted to the first touch circuit board 710 from the second touch circuit board 720.

Hereinafter, a method for controlling a cooking appliance according to an embodiment will be described with reference to FIG. 4.

Figure 4:
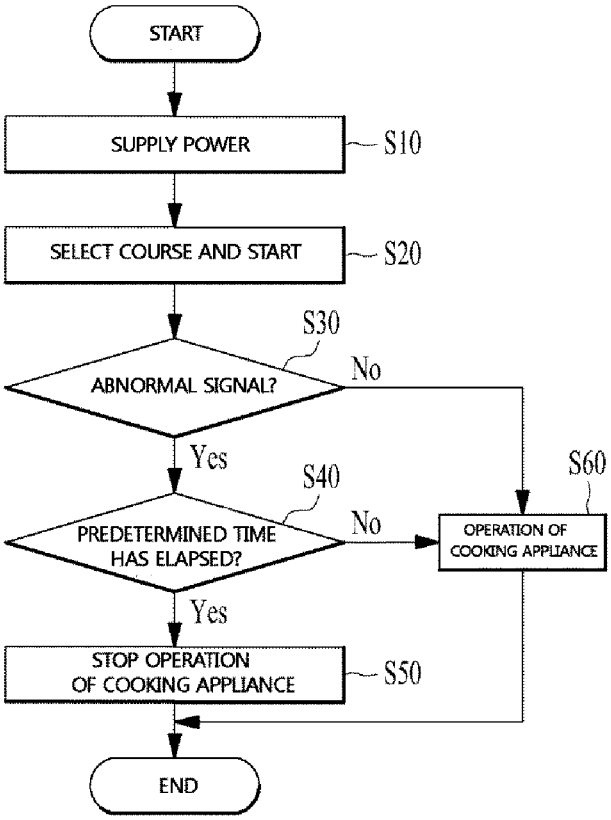
FIG. 4 is a flowchart illustrating a method for controlling a cooking appliance according to an embodiment.

FIG. 4 is a flowchart illustrating a method for controlling a cooking appliance according to an embodiment. In the explanation of the method for controlling a cooking appliance, it is apparent that components of the cooking appliance 10 described above with reference to FIGS. 1 through 3 may be applied to the method. In contrast, the cooking appliance control method described below may be applied to the cooking appliance 10 through the above-described controller 80.

Referring to FIGS. 1 through 4, the cooking appliance control method according to an embodiment relates to a method for controlling a cooking appliance, such as cooking appliance 10 of FIGS. 1-3, including a cooking unit or device, for example, a cooking chamber, such as cooking chamber 25 of FIGS. 1-3, to cook items to be cooked, such as food, using a heat source, a touch panel type input unit or input, such as touch panel type input 70 of FIGS. 1-3, including a first touch circuit board 710, such as first touch circuit board of FIGS. 1-3, and a second touch circuit board, such as second touch circuit board 720 of FIGS. 1-3, to receive a command for controlling operation of the cooking device, and a control unit or controller, such as controller 80 of FIGS. 1-3, to receive a touch signal input through the input and control operation of the cooking device.

The cooking appliance control method according to an embodiment may include a supply power step or operation S10, a select course and start step or operation S20, an abnormal signal determination step or operation S30, and a stop operation step or operation S50. In the supply power step or operation S10, power may be supplied to the cooking appliance. For example, the cooking appliance may be turned on through the input of the cooking appliance or a power button (not shown), which may be provided separately from the input at the cooking appliance.

In the select course and start step or operation S20, one of a plurality of courses may be selected and started through the input. For example, a plurality of courses displayed on the input may include START, CANCEL, WARM, and COOK, for example. The plurality of courses may be selected by touching a plurality of recognition units or devices provided at the input.

That is, the recognition devices may include a START command recognition unit or device, a CANCEL command recognition unit or device, a WARM command recognition unit or device, and a COOK command recognition unit or device. The CANCEL command recognition device may be provided at a first touch pad, such as first touch pad 71 of the input 70 of FIGS. 1-3, and the first touch pad may be electrically connected with the first touch circuit board. The START command recognition device, the WARM command recognition device, and the COOK command recognition device may be provided at a second touch pad, such as second touch pad 72 of the input 70 of FIGS. 1-3, and the second touch pad may be electrically connected with the second touch circuit board. As a connection relationship of the first touch pad, the first touch circuit board, the second touch pad, the second touch circuit board, and the controller may be similar or identical to that described above with reference to FIGS. 2 and 3, a detailed explanation thereof has been omitted.

In the abnormal signal determination step or operation S30, it may be determined whether an abnormal signal is transmitted from the first touch circuit board, which may recognize a touch signal from the CANCEL command recognition device provided at the first touch pad, to the second touch circuit board, which may communicate with the first touch circuit board. That is, in the abnormal signal determination step or operation S30, the controller or the second touch circuit board may determine whether an abnormal signal is transmitted from the first touch circuit board to the second touch circuit board.

In the stop operation step or operation S50, if it is determined that the abnormal signal is transmitted in the abnormal signal determination step or operation S30, the controller may stop operation of the cooking appliance (or operation of the cooking chamber).

That is, if it is determined that the abnormal signal is transmitted in the abnormal signal determination step or operation S30, the process may proceed to the stop operation step or operation S50, and the controller may control a power supply unit or power supply (not shown) of the cooking appliance so as to stop the operation of the cooking appliance or control the cooking chamber so as to stop the operation of the cooking chamber.

The cooking appliance control method according to an embodiment may further include a time determination step or operation S40, in which it may be determined whether the abnormal signal has been transmitted for a predetermined period of time. If it is determined that the abnormal signal has been transmitted for a predetermined period of time in the time determination step or operation 40, the controller may control the cooking appliance (or the cooking chamber) so as to stop the operation of the cooking appliance (or the cooking chamber).

Accordingly, when the CANCEL command recognition device is out of order due to at least one of a plurality of cases including damage of the CANCEL command recognition device, disconnection between the CANCEL command recognition device and the first touch circuit board, and damage of the first touch circuit board, the operation of the cooking appliance (or the cooking chamber) may automatically stop, thereby preventing secondary damage, such as fire.

According to an embodiment, in the abnormal signal determination step or operation S30, the second touch circuit board may transmit the abnormal signal from the first touch circuit board to the controller. Also, in the time determination step or operation S40, the controller may determine whether the controller has received the abnormal signal for the predetermined period of time.

That is, in the abnormal signal determination step or operation S30, the second touch circuit board may continuously transmit the abnormal signal from the first touch circuit board to the controller. At this time, the predetermined period of time for which the abnormal signal is continuously transmitted may be determined by the controller. Therefore, if the controller determines that the abnormal signal has been transmitted for the predetermined period of time, the controller may immediately stop the operation of the cooking appliance (or the cooking chamber) after the predetermined period of time has elapsed.

According to another embodiment, in the time determination step or operation S40, the second touch circuit board may determine whether the abnormal signal from the first touch circuit board has been transmitted for the predetermined period of time, and if it is determined that the abnormal signal has been transmitted for the predetermined period of time, the second touch circuit board may transmit a signal for stopping the operation of the cooking appliance (or the cooking chamber) to the controller. That is, according to this embodiment, in the time determination step or operation S40, the second touch circuit board may determine the predetermined period of time for which the abnormal signal is continuously transmitted.

If the second touch circuit board determines that the abnormal signal has been transmitted for the predetermined period of time, the second touch circuit board may transmit a signal for stopping the operation of the cooking appliance (or the cooking chamber) to the controller. The controller may immediately stop the operation of the cooking appliance (or the cooking chamber) when the controller receives the signal for stopping the operation of the cooking appliance (or the cooking chamber) from the second touch circuit board.

On the other hand, in the abnormal signal determination step or operation S30, if it is determined that an abnormal signal is not transmitted, that is, a normal signal is transmitted, to the second touch circuit board from the first touch circuit board, the process may proceed to a cooking appliance operation step or operation S60, in which the cooking appliance may continuously operate according to the selected course.

Although it is determined that the abnormal signal is transmitted to the second touch circuit board from the first touch circuit board in the abnormal signal determination step or operation S30, if it is determined that the abnormal signal has not been transmitted for the predetermined period of time in the time determination step or operation S40, the process may proceed to the cooking appliance operation step or operation S60, in which the cooking appliance may continuously operate according to the selected course. As described above, this is because, even when there is no special problem with the CANCEL command recognition device or the first touch circuit board, an abnormal signal may be transmitted to the second touch circuit board from the first touch circuit board for a moment or for a relatively short time due to external stimulus applied to the input or a program error, for example.

That is, when the abnormal signal is transmitted to the second touch circuit board from the first touch circuit board for a moment or for a relatively short time due to external stimulus applied to the input or an error of a program pre-stored in the controller, a state incapable of touch recognition of the CANCEL command recognition device does not continue for a relatively long time, and accordingly, the user may stop the operation of the cooking appliance or the cooking chamber at a desired time.

Further, as described above with reference to FIGS. 1 through 3, the second touch circuit board or the controller may sense the abnormal signal in at least one of the plurality of cases including damage of the CANCEL command recognition device provided at the first touch pad connected with the first touch circuit board, disconnection between the CANCEL command recognition device and the first touch circuit board, and damage of the first touch circuit board.

Embodiments disclosed herein provide a cooking appliance and a method for controlling a cooking appliance, which may enhance operational stability by stopping operation of the cooking appliance when at least one of a CANCEL command recognition device and a touch circuit board for receiving a touch signal from the CANCEL command recognition device malfunctions.

Embodiments disclosed herein further provide a cooking appliance and a method for controlling a cooking appliance, which may prevent malfunction of an input by preventing noise generation due to frequency interference.

Embodiments disclosed herein provide a cooking appliance that may include a cabinet that forms an outer appearance thereof, a cooking unit or device provided at the cabinet to cook food using a heat source, an input unit or input provided at the cabinet and configured as a touch panel to receive a command for controlling operation of the cooking unit, and a control unit or controller configured to receive a touch input signal from the input unit and control the operation of the cooking unit. The input unit may include a first touch circuit board and a second touch circuit board, and the first touch circuit board and the second touch circuit board may be configured to communicate with each other and to be electrically connected with the control unit.

If an abnormal signal is transmitted to the second touch circuit board from the first touch circuit board, the control unit may control the cooking unit to stop the operation of the cooking unit. If the abnormal signal has been transmitted for a predetermined time, the control unit may control the cooking unit to stop the operation of the cooking unit.

The input unit may include a COOK command recognition unit or device, a START command recognition unit or device, and a CANCEL command recognition unit or device. The first touch circuit board may be configured to recognize a touch signal input through the CANCEL command recognition unit and transmit the touch signal to the control unit, and the second touch circuit board may be configured to recognize a touch signal input through the START command recognition unit and the COOK command recognition unit and transmit the touch signal to the control unit.

The second touch circuit board may be configured to transmit the abnormal signal from the first touch circuit board to the control unit, and if the control unit has received the abnormal signal for the predetermined time, the control unit may control the cooking unit to stop the operation of the cooking unit. Alternatively, if the second touch circuit board has received the abnormal signal from the first touch circuit board for the predetermined time, the second touch circuit board may transmit a signal for stopping the operation of the cooking unit to the control unit. The second touch circuit board may be configured to sense the abnormal signal in at least one of a plurality of cases including damage of the CANCEL command recognition unit, disconnection between the CANCEL command recognition unit and the first touch circuit board, and damage of the first touch circuit board.

The signal transmitted from the first touch circuit board to the second touch circuit board may include a normal signal and an abnormal signal. The normal signal may be a signal in which a high-frequency signal and a low-frequency signal are alternately repeated, and the abnormal signal may be a signal in which either the high-frequency signal or the low-frequency signal is repeated.

The predetermined time may be in a range from approximately 3 minutes to approximately 5 minutes.

The control unit may be configured to continuously receive information about the abnormal signal, which may be transmitted from the first touch circuit board to the second touch circuit board, from the second touch circuit board, and the predetermined time may be determined by the control unit. Alternatively, if the second touch circuit board has received the abnormal signal from the first touch circuit board for the predetermined time, the second touch circuit board may transmit a signal for stopping the operation of the cooking unit to the control unit.

The input unit may include a first touch pad and a second touch pad, which may be respectively provided with one or more recognition units or devices. The first touch pad may be electrically connected with the first touch circuit board, and the second touch pad may be electrically connected with the second touch circuit board. The first touch pad may be provided with a CANCEL command recognition unit or device.

Embodiments disclosed herein further provide a method for controlling a cooking appliance, which may include a cooking unit or unit to cook food using a heat source, a touch panel type input unit or input including a first touch circuit board and a second touch circuit board to receive a command for controlling operation of the cooking unit, and a control unit or controller configured to receive a touch input signal from the input unit and control the operation of the cooking unit, that may include supplying power to the cooking appliance, selecting one of a plurality of courses through the input unit and starting the selected course, determining whether an abnormal signal is transmitted from the first touch circuit board, which may be configured to recognize a touch signal from a CANCEL command recognition unit or device provided at the input unit, to the second touch circuit board, which may communicate with the first touch circuit board, and stopping operation of the cooking appliance through the control unit upon determining that the abnormal signal is transmitted. The method may further include determining whether the abnormal signal has been transmitted for a predetermined time after the determining whether the abnormal signal is transmitted. Upon determining that the abnormal signal has been transmitted for the predetermined time, the operation of the cooking appliance may be stopped through the control unit.

In the determining whether the abnormal signal is transmitted, the second touch circuit board may transmit the abnormal signal from the first touch circuit board to the control unit. In the determining whether the abnormal signal has been transmitted for the predetermined time, the control unit may determine whether the control unit has received the abnormal signal for the predetermined time. Alternatively, in the determining whether the abnormal signal has been transmitted for the predetermined time, the second touch circuit board may determine whether the abnormal signal from the first touch circuit board has been transmitted for the predetermined time, and may transmit a signal for stopping the operation of the cooking appliance to the control unit upon determining that the abnormal signal has been transmitted for the predetermined time.

The method may further include, upon determining that a normal signal is transmitted in the determining whether the abnormal signal is transmitted or upon determining that the predetermined time has not elapsed in the determining whether the abnormal signal has been transmitted for the predetermined time, operating the cooking appliance continuously according to the selected course. In the determining whether the abnormal signal is transmitted, the second touch circuit board may sense the abnormal signal in at least one of cases including damage of the CANCEL command recognition unit, disconnection between the CANCEL command recognition unit and the first touch circuit board, and damage of the first touch circuit board.

According to embodiments disclosed herein, when the input unit is out of order, operation of the cooking appliance may be stopped, thereby preventing secondary damage, such as fire. Further, according to embodiments disclosed herein, when at least one of the CANCEL command recognition unit or the touch circuit board for receiving a touch signal from the CANCEL command recognition unit malfunctions, operation of the cooking appliance may be stopped, thereby enhancing operational stability. Furthermore, according to embodiments disclosed herein, noise generation due to frequency interference may be prevented, thereby preventing malfunction of the input unit.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance, comprising:

a cabinet that defines an outer appearance of the cooking appliance;

at least one cooking device provided in the cabinet to cook an item to be cooked using a heat source;

an input that receives a touch input signal for controlling operation of the at least one cooking device, wherein the input includes:

a first touch pad having one or more recognition devices including a CANCEL command recognition device for inputting a cancellation command to cancel an operation of cooking the item;

a first touch circuit board configured to receive a touch signal generated from the first touch pad;

a second touch pad having one or more recognition devices including a COOK command recognition device for inputting a cooking command to cook the item;

a second touch circuit board configured to receive a touch signal generated from the second touch pad; and a controller electrically connected with the first touch circuit board and the second touch circuit board, respectively, and configured to receive the touch input signal from the input and control the operation of the at least one cooking device, wherein the first touch circuit board is connected to the second touch circuit board through a communication such that the CANCEL command recognition device is connected to the second touch circuit board through the communication, wherein the first touch circuit board for recognizing a touch signal input from the CANCEL command recognition device transmits a specific signal to the second touch circuit board continuously, wherein the second touch circuit board continuously receives the specific signal and transmits the specific signal to the controller such that the controller senses an abnormal signal by determining a state of the specific signal, wherein when the controller determines the abnormal signal, the controller stops the operation of the at least one cooking device or operation of the cooking appliance, and wherein the first touch pad and the second touch pad are separately arranged such that the communication is interposed therebetween, and such that a damage of the CANCEL command recognition device connected to the first touch circuit board is sensed by the controller.

2. The cooking appliance according to claim 1, wherein if the abnormal signal has been transmitted for a predetermined period of time, the controller stops the operation of the at least one cooking device or the operation of the cooking appliance.

3. The cooking appliance according to claim 2, wherein the predetermined period of time is in a range of from approximately 3 minutes to approximately 5 minutes.

4. The cooking appliance according to claim 2, wherein the controller continuously receives information about the abnormal signal, which is transmitted from the first touch circuit board to the second touch circuit board, from the second touch circuit board, and wherein the predetermined period of time is determined by the controller.

5. The cooking appliance according to claim 2, wherein if the second touch circuit board has received the abnormal signal from the first touch circuit board for the predetermined period of time, the second touch circuit board transmits a signal for stopping the operation of the at least one cooking device or the operation of the cooking appliance to the controller.

6. The cooking appliance according to claim 1, wherein the input includes the COOK command recognition device, a START command recognition device, and the CANCEL command recognition device, wherein the first touch circuit board recognizes a touch signal input through the CANCEL command recognition device and transmits the touch signal to the controller, and wherein the second touch circuit board recognizes a touch signal input through the START command recognition device and the COOK command recognition device and transmits the touch signal to the controller.

7. The cooking appliance according to claim 6, wherein if the controller has received the abnormal signal for a predetermined period of time, the controller stops the operation of the at least one cooking device or the operation of the cooking appliance.

8. The cooking appliance according to claim 6, wherein if the second touch circuit board has received the abnormal signal from the first touch circuit board for a predetermined period of time, the second touch circuit board transmits a signal for stopping the operation of the at least one cooking device or the operation of the cooking appliance to the controller.

9. The cooking appliance according to claim 1, wherein a signal transmitted from the first touch circuit board to the second touch circuit board includes a normal signal and the abnormal signal, and wherein the normal signal is a signal in which a high-frequency signal and a low-frequency signal are alternately repeated, and the abnormal signal is a signal in which either the high-frequency signal or the low-frequency signal is repeated.

10. The cooking appliance according to claim 1, wherein the at least one cooking device includes at least one of a cooking chamber or a cooktop.

11. The cooking appliance according to claim 1, wherein the specific signal includes a repeated signal of a first pattern.

12. The cooking appliance according to claim 11, wherein the abnormal signal includes a repeated signal of a second pattern which is different from the first pattern.

13. The cooking appliance according to claim 1, wherein only the first touch pad includes the CANCEL command recognition device .

14. The cooking appliance according to claim 1, wherein the first touch circuit board and the second touch circuit board are, respectively, connected with the controller by separate electrical connection means.

* * * * *